US005700052A

United States Patent [19]

Yamazaki et al.

[11] Patent Number: 5,700,052

[45] Date of Patent: Dec. 23, 1997

[54] CHAIR FOR AN ACOUSTICALLY DESIGNED BUILDING

[75] Inventors: Ryokichi Yamazaki, Tokyo; Takeshi Sakai; Fukushi Kawakami, both of Hamamatsu, all of Japan

[73] Assignee: Yamaha Corporation, Hamamatsu, Japan

[21] Appl. No.: 557,202

[22] Filed: Nov. 14, 1995

[30] Foreign Application Priority Data

Nov. 14, 1994 [JP] Japan ..... 6-279280
Jun. 26, 1995 [JP] Japan ..... 7-159369

[51] Int. Cl.[6] ..... A47C 31/00

[52] U.S. Cl. ..... 297/217.3; 297/452.46; 297/249; 181/30; 181/295

[58] Field of Search ..... 297/217.3, 249, 297/452.46; 181/295, 30

[56] References Cited

U.S. PATENT DOCUMENTS

| | | | |
|---|---|---|---|
| 704,616 | 7/1902 | Charles | 297/217.3 |
| 1,825,465 | 9/1931 | MacDonald | 181/30 |
| 1,975,604 | 10/1934 | Hanson | 181/30 |
| 2,277,983 | 3/1942 | Jacobs | 181/30 |
| 3,382,947 | 5/1968 | Biggs | 181/30 |
| 3,411,605 | 11/1968 | Coffman et al. | 181/30 |
| 3,567,276 | 3/1971 | Van Ryn | 297/248 X |
| 3,628,829 | 12/1971 | Heilig | 297/217.3 X |
| 4,516,656 | 5/1985 | Fleshler | 181/175 |
| 4,977,600 | 12/1990 | Ziegler | 381/71 |

FOREIGN PATENT DOCUMENTS

| | | | |
|---|---|---|---|
| 5183/31 | 12/1931 | Australia | 181/30 |
| 589790 | 12/1933 | Germany | 181/30 |
| 822170 | 10/1951 | Germany | 181/30 |
| 944890 | 6/1956 | Germany | 181/30 |
| 2724717 | 12/1978 | Germany | 181/30 |
| 3519682 | 12/1986 | Germany | 181/295 |
| 62-512 | 6/1982 | Japan . | |
| 5143081 | 6/1993 | Japan | 181/30 |
| 194440 | 3/1923 | United Kingdom | 181/30 |

OTHER PUBLICATIONS

Journal of the Acoustical Society of America, vol. 32, No. 3, Mar. 1960, pp. 371–375, Mar. 1960.

*Primary Examiner*—Peter M. Cuomo
*Assistant Examiner*—David E. Allred
*Attorney, Agent, or Firm*—Loeb & Loeb LLP

[57] ABSTRACT

A chair includes a main body with a seat, openings formed in the greater part of the lower surface of the seat, a sound absorbing structure contained in the seat while facing the openings, and a louver having a series of openings defined with a number of slats that may be turned for opening and closing. The louver is located in front of the series of openings. When the seat is unoccupied, the slats of the louver are turned for opening. When the seat is occupied, the slats are turned for closing. The chair is adequate for concert halls or theaters.

10 Claims, 10 Drawing Sheets

CHAIR FOR AN ACOUSTICALLY DESIGNED BUILDING

BACKGROUND OF THE INVENTION

1. Field of the Invention

The present invention relates to a chair adapted for acoustically designed buildings, such as concert halls, auditoriums and theaters.

2. Related Art

In concert halls, auditorium or theaters acoustically designed for providing quality sound and ambience, decisive factors are a direct sound, a lasting sound and intensity of reverberation following the direct sound, that is, the acoustics.

Particularly in orchestral sounds generated by various musical instruments, minute differences of reverberation characteristics are amplified when they are acoustically perceived by an audience.

Recent concert halls, auditoriums, theaters, and the like, are precisely designed taking such acoustics into account.

In giving a concert in a carefully acoustically designed concert hall, the tones of various musical instruments are almost perfectly adjusted for good harmony by careful rehearsal. However, the acoustics are unsatisfactory in the actual concert given later in the same hall.

The problem arises from the nonuniformity of the equivalent sound absorption area over the seating area of the hall. The seats of the hall greatly influence the acoustics of the hall.

The listeners themselves provide a large equivalent sound absorption area. Accordingly, the reverberation time of the hall is greatly varied depending on the number of listeners in the hall.

In other words, the reverberation time of the hall when vacant may be greatly different from that when the hall is not vacant.

For this reason, various attempts have been made to acoustically improve the construction of the chairs for acoustically designed buildings.

A specific example is a chair having the following construction. The seat of the chair is turned about the support located at the fore end of the seat. A trapezoidal sound absorber is mounted on the seat, with the sound absorbing surface thereof directed upward.

When a listener sits on the above-described seat, the sound absorbing surface is covered. When the listener rises from the seat, the sound absorber is exposed to thereby provide an equivalent sound absorption area substantially equal to that of the listener.

Thus, the hall with these constructed chairs installed therein, even when vacant, is capable of approximately maintaining the equivalent sound absorption area to a hall that is not vacant. The use of the chairs remarkably reduces the influence of the number of listeners seated in the hall upon the reverberation time of the hall.

The chair of this type has the following disadvantages, however. The sound absorber is mounted on the outside of the chair since the sound absorbing surface must be exposed and covered with something. The result is the increased size of the chair. The increased chair size is a problem to be solved for chairs for these types of buildings.

To solve the problem, a chair in which the sound absorber is provided within the seat is proposed by Japanese Utility Model Publication No. Sho. 62-512.

The construction of the chair in FIG. 12 shows a sound absorbing material c contained in a seat b of a main body a of the chair. A number of holes e are formed in the lower surface d of the seat b.

A punched plate g with a number of punched holes f is inserted between the lower surface d of the seat and the sound absorbing material c. The punched plate g is slidable longitudinally to the fore of the chair and to the rear of the chair.

A stopper h is mounted on the top of a frame i of the chair. When a listener sits on the seat or rises from the seat, the punched plate g interacts with the stopper h to slide as shown in FIG. 12.

The chair thus constructed operates such that when a listener sits on the seat, the punched plate g hits against the stopper h, to thereby be moved forward until the punched plate g closes the hole e of the lower surface d of the seat b.

When the listener rises from the seat, the punched plate g slides down to the rear side by gravity until the punched holes f of the punched plate g are aligned with the holes e of the seat b to expose the sound absorbing material c to the outside. In this state, the chair containing the sound absorbing material c has an equivalent sound absorption area nearly equal to that of the listener.

For chairs of acoustically designed buildings, it is ideal that the difference between the equivalent sound absorption area of the unoccupied chair and the occupied seat be as small as possible, and zero if possible. In the concert hall, for example, having little or no difference in equivalent sound absorption area, the reverberation time of the hall is little varied even if the number of listeners is varied.

To realize this, it is essential to achieve as large an area as possible for sound absorption. One of the possible ways to realize this is to maximize the opening through which the sound absorber is exposed to the exterior.

In the above-mentioned chair constructed such that the punched plate g is slid to open and close the holes e of the lower surface d of the seat b, the maximum area of the opening that can be secured is half of the whole area of the lower surface d of the seat b because of the restriction created by the open/close structure.

For this reason, there is a limit in reducing the difference of the equivalent sound absorption area.

SUMMARY OF THE INVENTION

Accordingly, an object of the present invention is to provide a chair for acoustically designed buildings which can considerably reduce the difference between the equivalent sound absorption area of the chair when a listener sits on the seat of the chair and that when no one sits on the chair.

Another object of the present invention is to provide for acoustically designed buildings a chair which, when coupled to others side by side, leaves a space available for passage when the seats of the chairs are vacant.

Yet another object of the present invention is to provide a chair for acoustically designed buildings which is operable with less noise generated.

Still another object of the present invention is to provide a chair for acoustically designed buildings which is more reliably operable.

An additional object of the present invention is to provide a chair which is applicable to a variety of acoustically designed buildings.

To achieve the above, there is provided a chair comprising: a main body with a seat; openings formed in the greater part of the lower surface of the seat; sound absorbing means contained in the seat while facing the openings; and louver means having a series of openings defined with a number of slats turned for opening and closing, the louver means being located in front of the openings, when the seat is unoccupied with a listener, the slats being turned for opening, and when the seat is occupied with a listener, the slats being turned for closing.

With such a chair construction, when a listener sits on the seat, a number of slats of the louver are turned to close the openings. As a result, the sound absorbing means is shut off from outside.

When the listener rises from the seat, those slats of the louver are turned to open the large openings of the lower surface of the seat.

In this state, the sound absorbing means is exposed through the large openings to the exterior, to thereby provide an equivalent sound absorption area nearly equal to that of the sitter.

The effective area of the opening necessary for sound absorption is much larger than that of the conventional structure using the slidable punched plate, since a number of the openings defined with a number of the slats form the openings for the sound absorption.

Since the chair is thus constructed, the difference between the equivalent sound absorption area of the chair when occupied and that when unoccupied is considerably reduced.

In the first chair, the seat is turned between a first position when the seat is unoccupied [with a sitter] and a second position when the seat is occupied.

With this construction, when a plural number of the chairs are coupled with one another, side by side, a space for passage is secured when the seats of the chairs are vacant and turned upward.

According to another aspect of the present invention, there is provided a chair (referred to as a second chair) comprising: a main body with a seat, the seat being turned between a first position when the seat is unoccupied and a second position when the seat is occupied; openings formed in the greater part of the lower surface of the seat; sound absorbing means located in a space within the seat so that the sound absorbing means is movable to and apart from the openings; louver means having a series of openings defined with a number of slats that are turned for opening and closing, the louver means being rotatably supported between the sound absorbing means and the openings, the slats of the louver means being turned with the movement of the sound absorbing means to and apart from the openings so that when the seat is unoccupied, the slats are turned for opening, and when the seat is occupied, the slats are turned for closing; and a louver open/close mechanism provided on the rear side of the sound absorbing means for moving the sound absorbing means to and apart from the openings.

With such a construction, when the seat is in the second position, the sound absorbing means is moved toward the openings by the louver open/close mechanism located behind the sound absorbing means.

Then, the slats of the louver, located between the openings and the sound absorbing means, are turned to expose the large openings of the lower surface of the seat to the exterior.

In this state, the second chair, like the first chair, has an equivalent sound absorption area nearly equal to that of the sitter.

When a sitter pushes down the seat and sits on it, the sound absorbing means is moved apart from the openings by the louver open/close mechanism. With the movement, the slats of the louver, located between the openings and the sound absorbing means, are turned to close the openings. Accordingly, the openings are shut off from the exterior.

A little difference is produced between the equivalent sound absorption area of the chair when a sitter sits on the seat of the chair and that when no sitter sits on the chair.

In the second chair, the louver open/close mechanism includes urging means, located in the space of the seat, for urging the sound absorbing means to move apart from the openings, to thereby turn the slats of the louver means for opening, and levers, located within the space of the seat, for pushing the rear side of the sound absorbing means to close the slats of the louver means, with the turn of the seat to the second position.

With this construction, when the seat is at the first or unoccupied position, the sound absorbing means is moved apart from the openings by the urging means, and the sound absorbing means are exposed to the exterior through the openings.

When the seat is turned to the second or the occupied position, the lever pushes the rear side of the sound absorbing means, which has been urged by the urging means, to move the sound absorbing means to the openings. As a result, the slats of the louver are closed, and the openings are shut off from the exterior. Thus, the louver open/close mechanism thus operated is contained in the space within the seat, and the space of the seat is effectively used.

The construction of the louver open/close mechanism is simple since it consists of the combination of the urging means for urging the sound absorbing means and the lever for pushing the rear side of the sound absorbing means.

In the second chair, the levers include rollers which are brought into contact with the sound absorbing means when the levers push the rear side of the sound absorbing means.

Thus, the rollers of the levers are brought into contact with the rear side of the sound absorbing means. Therefore, the turn of the slats of the louver for opening and closing is smooth with little noise generated.

In the second chair, anti-skid layers are formed on the portion of the rear side of the sound absorbing means which receives the rollers.

With provision of the anti-skid layers, the levers roll on the anti-skid sheets on the rear side of the sound absorbing means. Therefore, the levers roll without slippage. This leads to a reliable opening/closing of the louver.

Each of the first and the second chairs may further comprise an opening/adjusting mechanism for adjusting the degree of the opening of the slats of the louver means.

Therefore, when a preset equivalent sound absorption area of the chair must be changed, it can be adjusted as desired by using the opening/adjusting mechanism with the chair in a vacant state.

Therefore, the chairs with the opening/adjusting mechanisms may be installed in a variety of concert halls.

Each of the first and the second chairs may further comprise a sound attenuation chamber provided on the rear side of the sound absorbing means.

The sound attenuation chamber attenuates incoming sound. The sound attenuation by the sound attenuation chamber and the sound absorption by the sound absorbing means cooperate to provide a large equivalent sound absorption area of the chair.

BRIEF DESCRIPTION OF THE DRAWINGS

Other features and advantages of the invention will be apparent from the following description taken in connection with the accompanying drawings, in which:

FIG. 10(*b*) is a graph showing a sound absorbing performance of the chair of the invention;

DETAILED DESCRIPTION OF THE PREFERRED EMBODIMENTS

A first embodiment of a chair according to the present invention will be described with reference to FIGS. 1 to 10.

Figure 1:
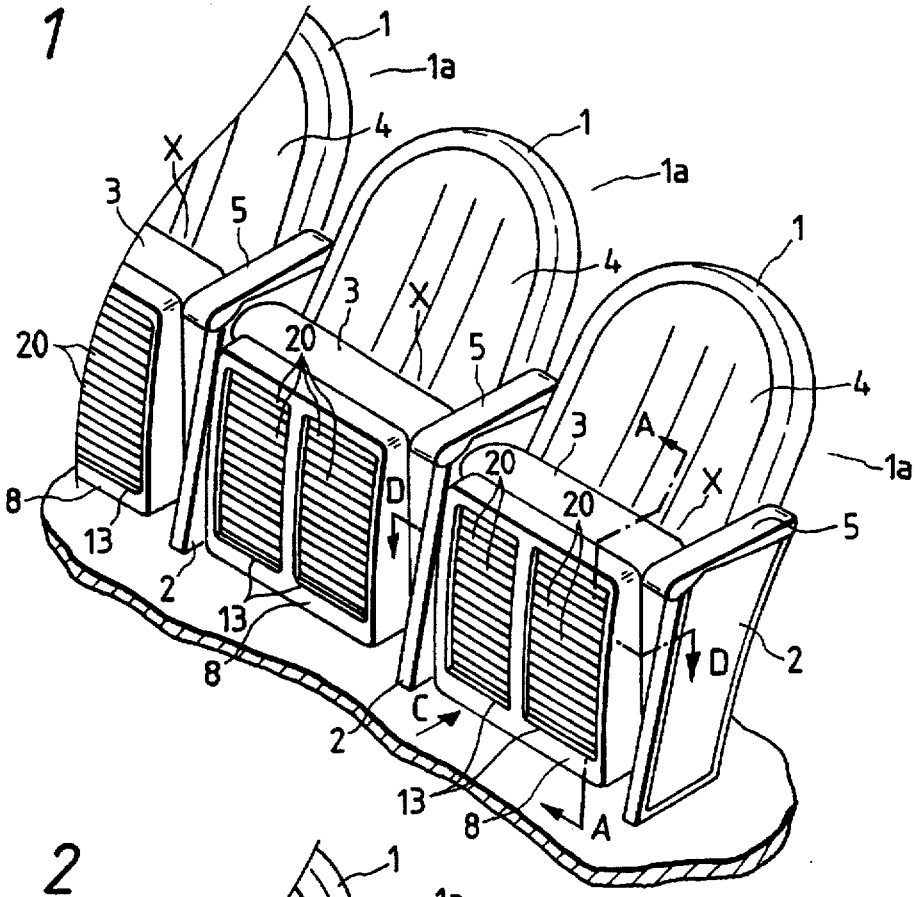
FIG.1 is a perspective view showing chairs for concert halls, for example, which incorporate the present invention, the chairs being vacant.
Figure 2:
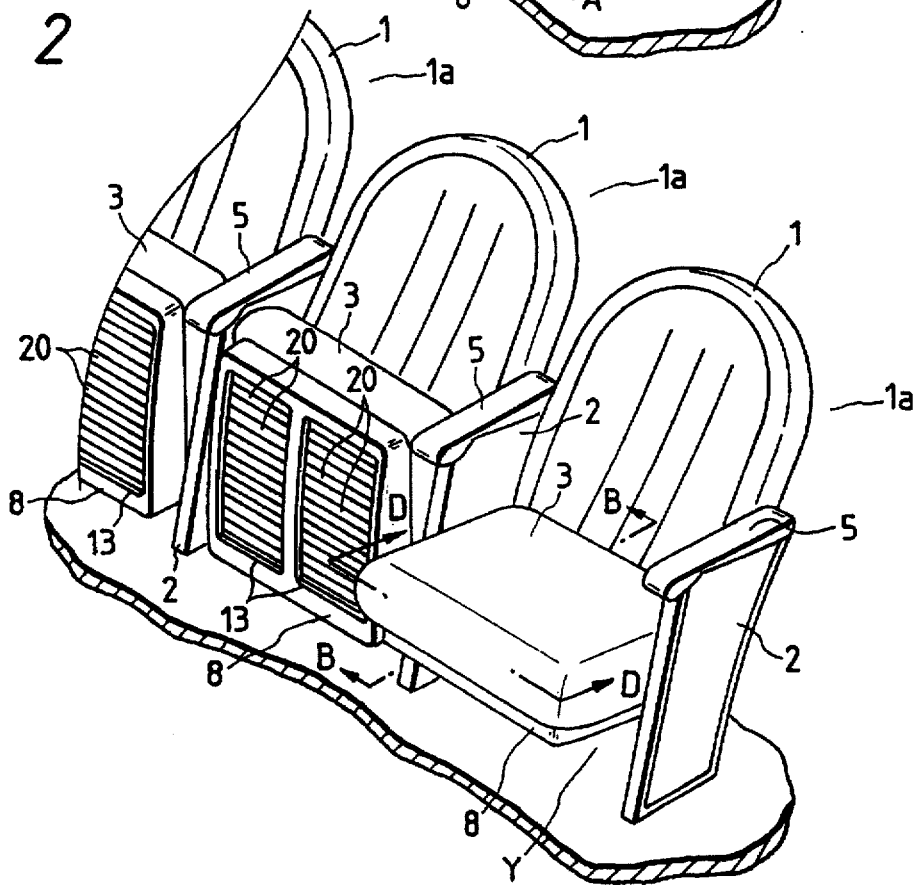
FIG. 2 is a perspective view showing the chairs of FIG. 1, one of the chairs ready for the seating of a sitter while the remaining ones are vacant.

FIGS. 1 and 2 perspectively illustrate the chair of the first embodiment. The details of the chair are illustrated in FIGS. 3 to 7.

The chair of the present invention is adequate for an acoustically designed building, such as a hall or a theater. In such a building, a plural number of the chairs of the invention are coupled to seat a plural number of people side by side, as shown in FIGS. 1 and 2.

Each chair designated by reference numeral 1 has a main body 1*a*, which is made up of plate-like legs 2 defining both sides of each chair, a seat 3 rotatably located between the plate-like legs 2, a back 4 extended upward from the rear side of the seat 3, and armrests 5 respectively fastened to the top sides of the plate-like legs 2.

The seat 3 of the chair 1 includes a sound-absorbing structure, which is essential to the present invention.

Figure 8:
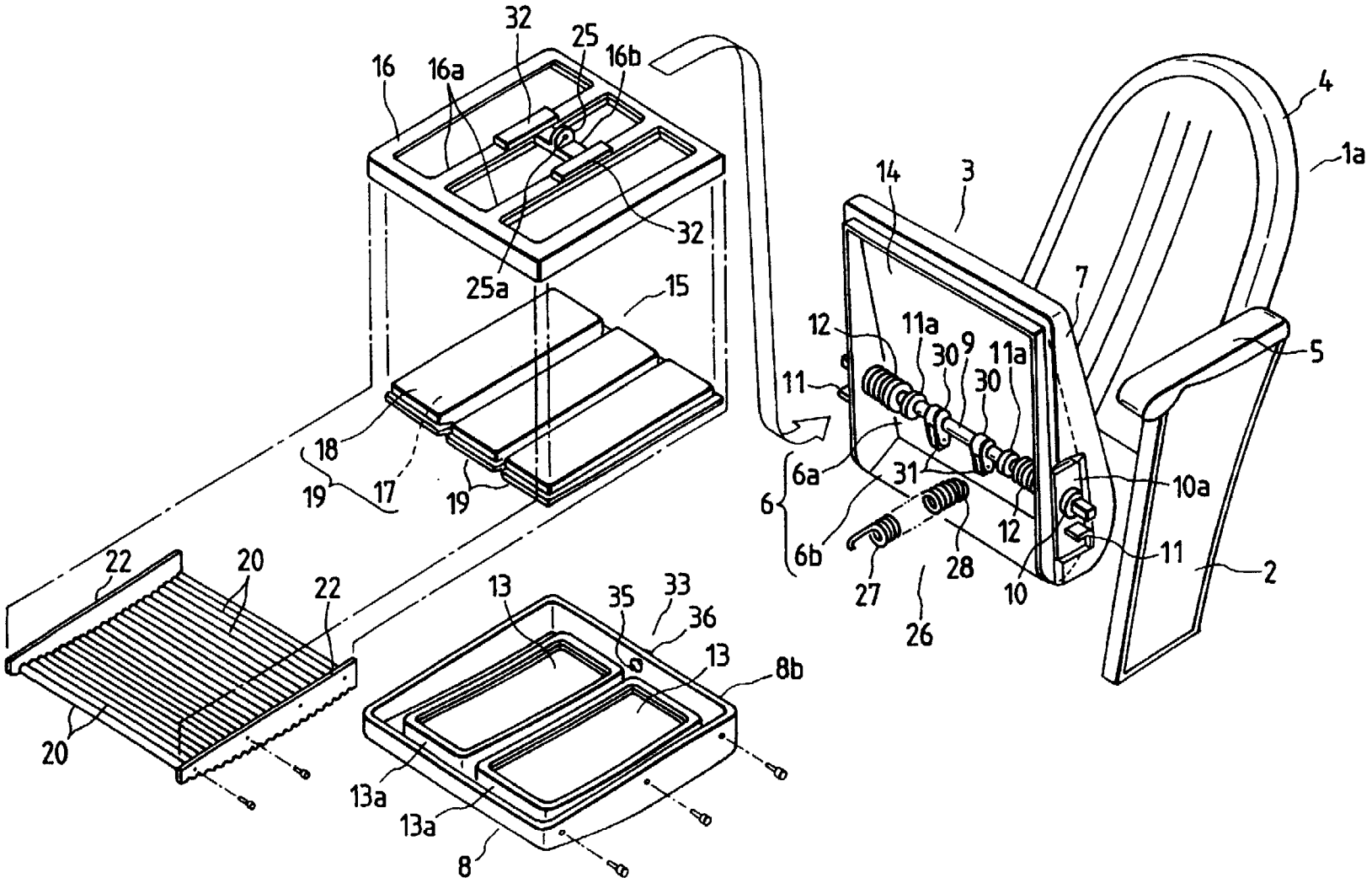
FIG. 8 is an exploded view showing the chair shown in FIG. 1, the seat structure and the sound absorbing structure being illustrated.
Figure 9:
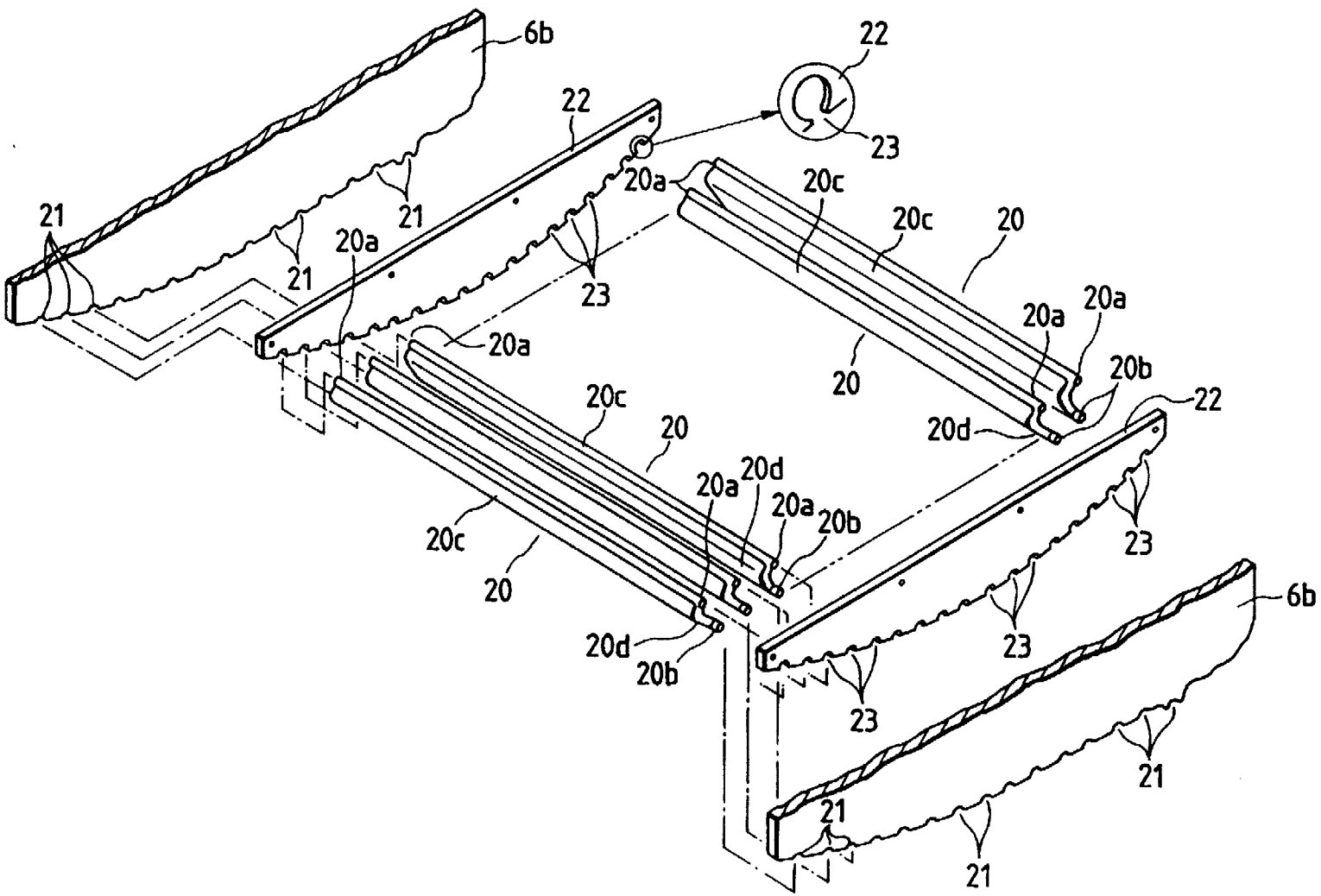
FIG. 9 is an exploded view showing the structure of a louver in the chair.

The sound-absorbing structure assembled into the seat 3 of the chair 1 is illustrated in an exploded fashion in FIG. 8.

The structure of the seat 3, which includes the sound-absorbing structure, will first be described.

Reference is made to FIGS. 3 to 5, and 8. In these figures, reference numeral 6 designates a seat frame. The seat frame 6 consists of a bottom surface 6*a* and an enclosing wall 6*b*. The enclosing wall 6*b* is raised from the four sides of the bottom surface 6*a* to enclose the bottom surface 6*a*. The portions of the enclosing wall 6*b* (referred to as the side walls of the frame 6), which are raised from both sides of the bottom surface 6*a*, gradually increase their height from the fore side of the bottom surface 6*a* to the rear side thereof. Accordingly, the top sides of those portions of the enclosing wall 6*b*, i.e., the side walls of the seat frame 6, are sloped upward from the fore ends of the top sides to the rear ends thereof.

The rear portion of the enclosing wall 6*b* is raised, at a slant, from the rear side of the bottom surface 6*a*.

The seat frame 6 includes a cushion 7, which covers the bottom surface 6*a* and the bottom part of the enclosing wall 6*b*. Use of the cushion 7 provides comfortable seating.

A back cover 8 is fastened to the seat frame 6 by means of suitable fixing means, such as screws, while covering the opening thereof defined by the enclosing wall 6*b*.

The seat frame 6 with the cushion 7 and the back cover 8 are combined to form the seat 3.

A rotary shaft 9 is bridged between the side walls of the seat frame 6 at the locations thereof closer to the rear side of the seat frame 6. More specifically, the rotary shaft 9 is rotatably supported by means of shaft support means 10 provided in the side walls of the seat frame 6 in a state that the end parts of the rotary shaft 9 are respectively extended outside the side walls.

The ends of the rotary shaft 9 are fastened to the plate-like legs 2, respectively. The seat 3 is turned about the rotary shaft 9 between two positions. At a first or unoccupied position, the seat 3 is vertically set in an unoccupied state (FIG. 1). At a second or occupied position, the seat 3 of one of the chairs is horizontally set in an occupied state (FIG. 2). In this state, the seat is ready for an occupant.

A more detailed description of those positions will be given later.

Figure 7:
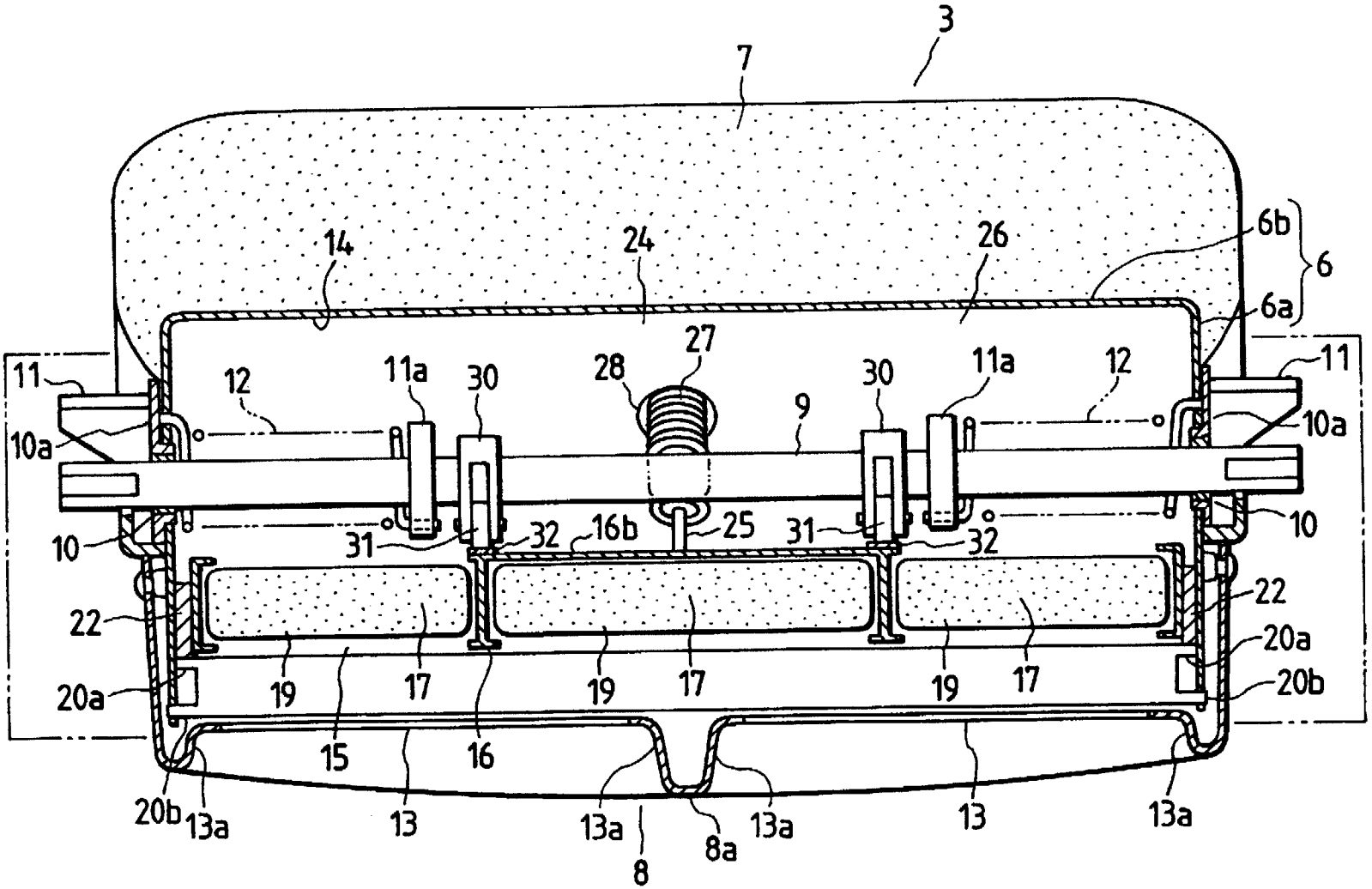
FIG. 7 is a cross-sectional view taken on line D—D in FIG. 2.

Referring to FIG. 7, protrusions 11 protrude outward from bearing mounting plates 10*a* of the shaft support means 10. In association with the protrusions 11, a couple of vertically spaced receiving means (not shown) protrude inward from the inner sides of each of the plate-like legs 2.

Figure 3:
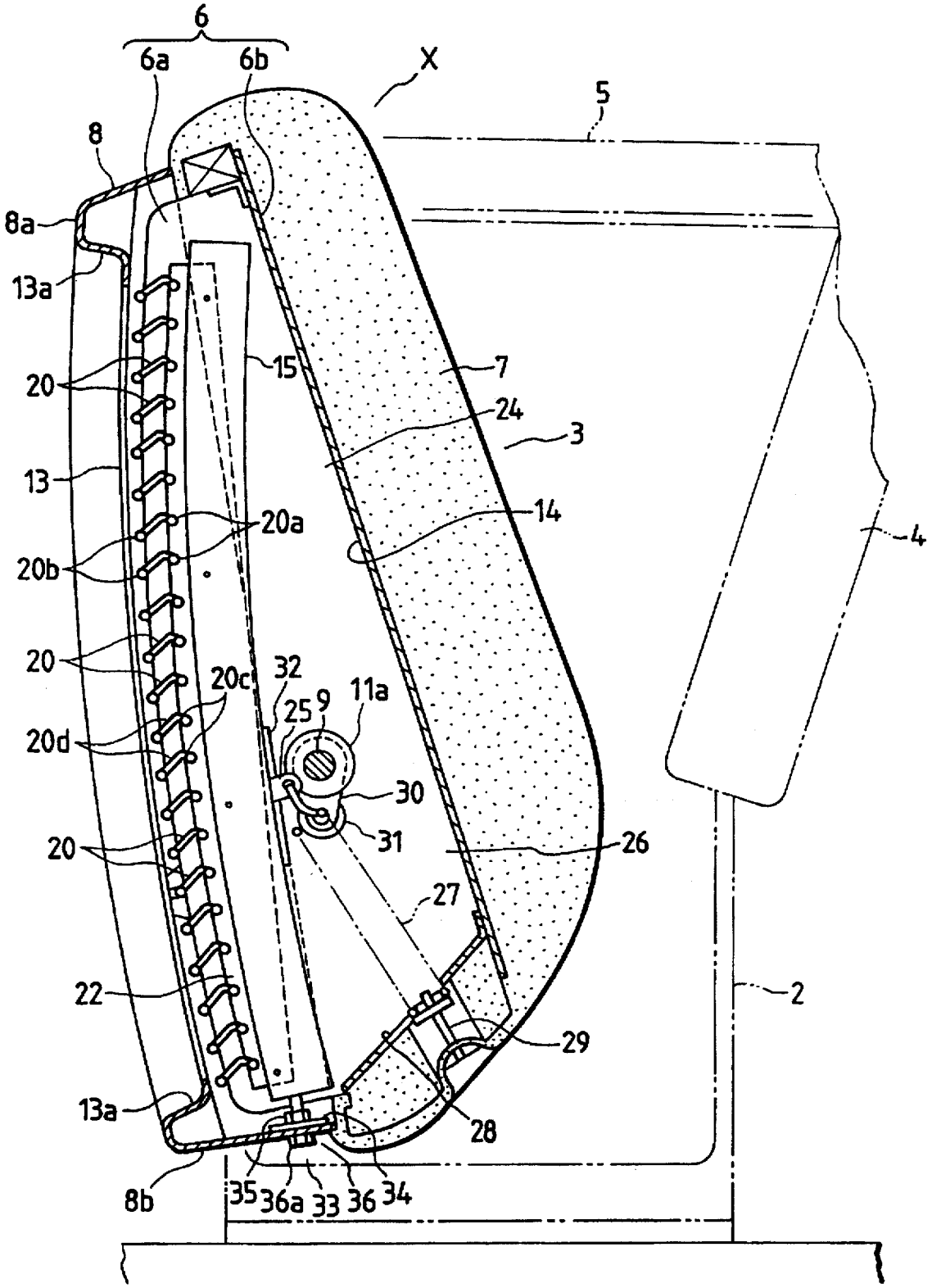
FIG. 3 is a cross-sectional view taken on line A—A in FIG. 1.
Figure 4:
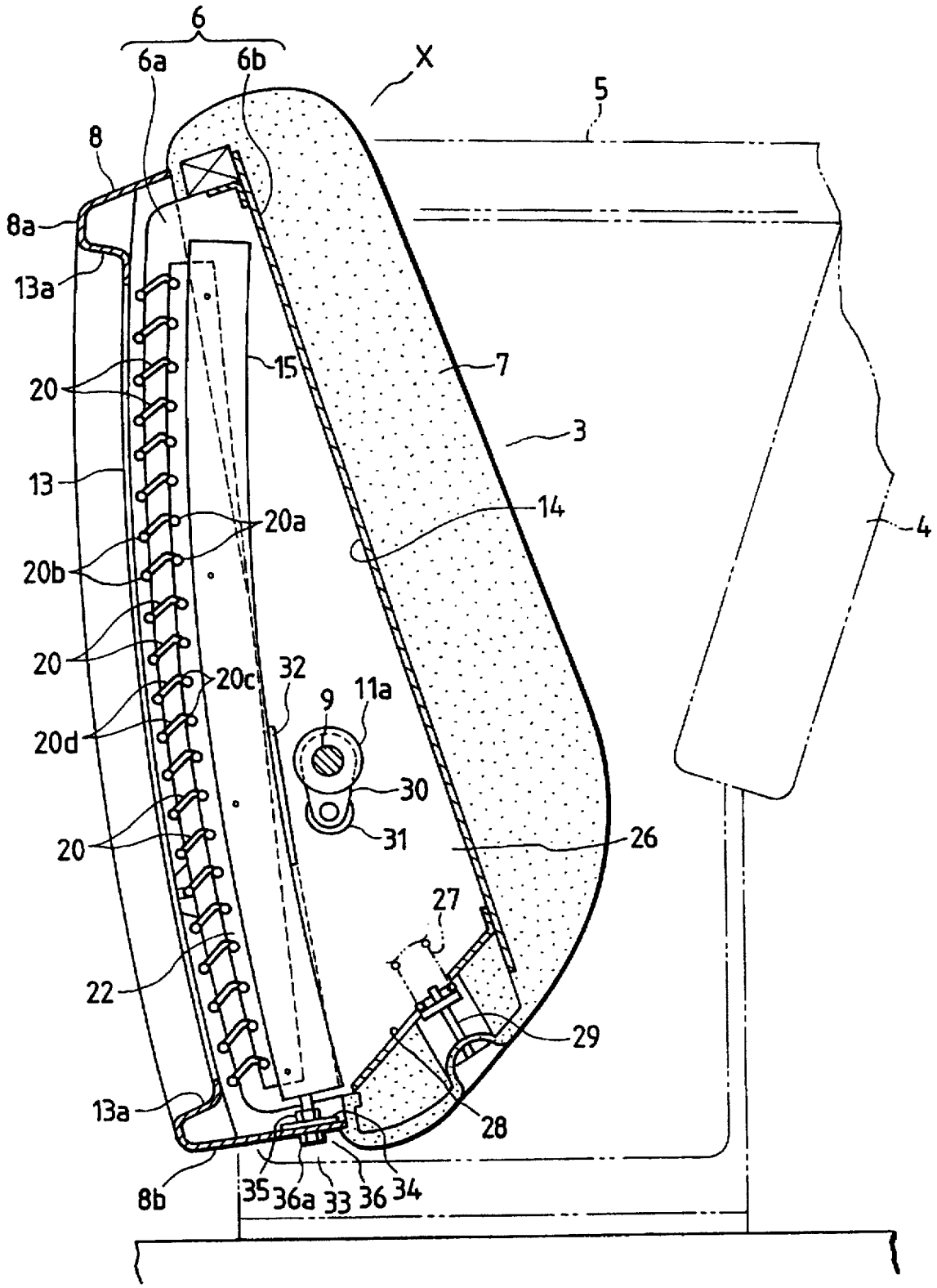
FIG. 4 is a cross-sectional of the chair, useful in explaining the relationship between a sound absorbing means and a lever when the seat is unoccupied.
Figure 5:
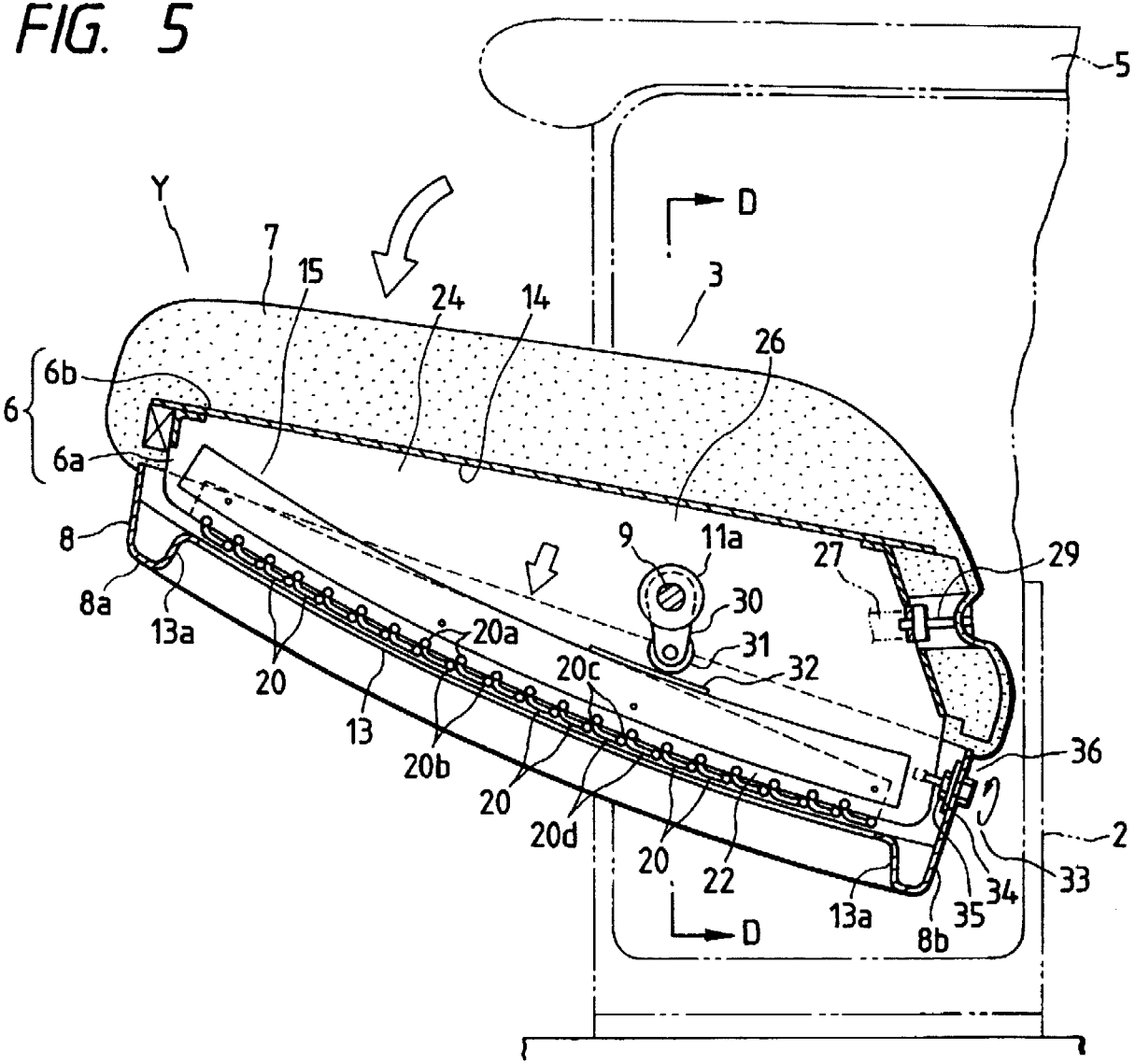
FIG. 5 is a cross-sectional view taken on line B—B in FIG. 2.
Figure 6:
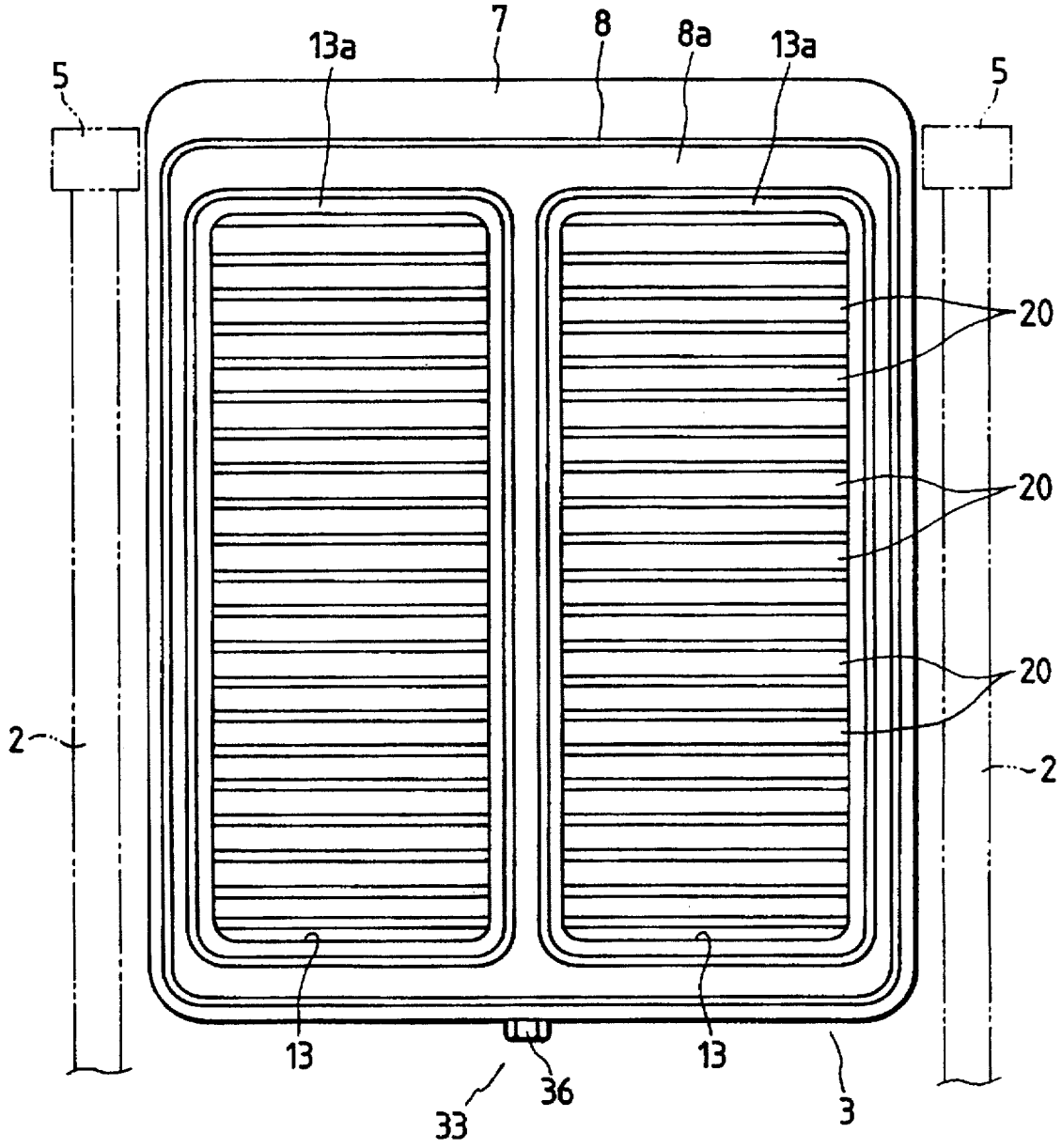
FIG. 6 is a view of the chair when viewed in the direction of an arrow C in FIG. 1.

When the seat 3 is vertically set at the first position (denoted as X in FIGS. 1, 3 and 4), the seat 3 is in an unoccupied state, and the protrusions 11 are brought into contact with the receiving means for setting up the first position X. When the seat 3 is horizontally set at the second position (denoted as Y in FIGS. 2 and 5), the seat 3 is in a sitter-acceptable state, and the protrusions 11 are brought into contact with the receiving means for setting up the second position Y. Thus, when the seat 3 is turned upward, it is stopped by the receiving means and vertically set as shown in FIGS. 1, 3 and 4. When it is turned downward, it is stopped by the related receiving means and horizontally set as shown in FIGS. 2 and 5.

Within a space of the seat frame 6, which is enclosed by the enclosing wall 6*b*, spring stoppers 11*a* are formed around the rotary shaft 9 at locations closer to the side walls of the seat frame 6. Coiled springs 12 are respectively inserted between the stoppers 11*a* and the corresponding side walls of the seat frame 6 (FIGS. 7 and 8). Each of the coiled spring 12 thus inserted is fixed at one end to the spring stopper 11*a* and at the other end to the side wall of the seat frame 6.

The coiled spring 12 is twisted in advance to create the torsion needed to urge the seat 3 to turn upward. Accordingly, with the aid of the coiled spring 12 thus twisted, the seat 3 is always kept in the unoccupied state unless the seat 3 receives a force to turn it downward.

A sound absorbing structure is constructed in the seat 3 that may be turned to move between the first position X and the second position Y.

The sound absorbing structure will be described. In FIG. 8, reference numeral 13 designates openings for sound absorption which are formed in the back cover 8 that covers the underside of the seat 3.

The openings 13, rectangular in shape, are formed preferably as large as possible in the bottom surface 8*a* of the back cover 8. To this end, in the present embodiment, the openings 13 are formed occupying most of the bottom surface 8*a*, except the central part thereof. Wall 13*a* is raised from the entire edge of each of the rectangular openings 13 (FIGS. 3, 5, 7 and 8).

Sound absorbing means 15 are contained in a space 14 defined by the seat frame 6, which faces the openings 13 of the bottom surface 8*a* of the back cover 8.

The sound absorbing means 15 is constructed so as to be contained in a case structure.

To be more specific, a rectangular flat case 16 is used for the case structure. The lateral length of the case 16 is substantially equal to the corresponding one of the space 14, and the longitudinal length thereof (between the front thereof and the rear end) is slightly shorter than the corresponding one of the space 14. The case 16 is somewhat arcuate when viewed longitudinally.

Sound absorbing material, e.g., glass wool 17, is contained in a bag 18, to thereby form a sound absorber 19. Three sound absorbers 19 are put in the case 16 in this embodiment. The bag 18 permits sound to transmit therethrough, as a matter of course.

The size of the case 16 is selected to allow the sound absorbing means 15 to be movable in the directions in which the sound absorbing means 15 approaches and moves apart from the openings 13. Further, the sound absorbing means 15 is movable longitudinally, to the front side and the rear side of the seat 3.

In the space 14, a sound attenuation chamber 24 is formed on the rear side of the sound absorbing means 15 as seen from FIG. 7.

As seen from FIG. 8, an engaging piece 25 protrudes from the center position on the upper side of the sound absorbing means 15, which is exposed to the sound attenuation chamber 24.

To be more specific, two strips 16*a* that are properly spaced from each other, and a connection plate 16*b* are formed in the central portion of the upper surface of the case 16. The two strips 16*a* are interconnected at the mid positions thereof by the connection plate 16*b*.

The engaging piece 25 with a through hole 25*a* protrudes from the mid position of the connection plate 16*b*.

As best illustrated in FIGS. 4, 5, 7, 8 and 9, a louver 20A is located between the sound absorbing means 15 and the openings 13. The louver 20A is formed of a number of slats 20, which are arranged side by side in the longitudinal direction of the seat 3 while being located between a couple of louver guide plates 22 directed longitudinally.

Each slats 20 is made of synthetic resin and shaped like an inverse U. The length of the slat 20 is substantially equal to the width of the space 14.

The slat 20 includes a short leg part 20*c* and a long leg part 20*d*. Pins 20*a* are extended outward from both ends of the short leg part 20*c* of the slat 20. Pin 20*b* are also extended outward from both ends of the long leg part 20*d* of the slat 20.

The pins 20*b* of the slats 20 are put on a number of arcuate steps 21 of the lower edge of the side walls of the seat frame 6, the portions of the enclosing wall 6*b* that are raised from both sides of the bottom surface 6*a* of the seat frame 6. The arcuate steps 21 are arrayed at the pitches that are equal to those of the slats 20 of the louver 20A.

The pins 20*a* of the slats 20 rotatably engage with the couple of the louver guide plates 22, which are fastened to both sides of the case 16.

Specifically, each of the louver guide plates 22 has a slightly arcuate lower edge. The lower part of the louver guide plate 22 is extended below the lower side of the case 16.

A number of semicircular slits 23 are formed on the lower edge of each of the louver guide plates 22. The pitches of those semicircular slits 23 are equal to the pitches of the slats 20 of the louver 20A. The pins 20*a* of the slats 20 are rotatably put in those semicircular slits 23 of the lower edges of the louver guide plates 22, respectively.

The louver 20A, supported at the pins 20*a* and 20*b*, is arranged such that the slats 20 thereof are turned to open and close between the sound absorbing means 15 and the openings 13.

When the sound absorbing means 15 moves toward the openings 13, the slats 20 are turned forward about the pins 20*b* thereof, to thereby close. When the sound absorbing means 15 moves apart from the openings 13, the slats 20 are turned backward, to thereby open.

Thus, with the movement of the sound absorbing means 15 to and from the openings 13, the slats 20 are turned within the range between a fully open position and a fully closed position.

A louver open/close mechanism 26 is provided in the sound attenuation chamber 24 provided on the rear side of the sound absorbing means 15. The louver open/close mechanism 26 moves the sound absorbing means 15 when the seat 3 is turned.

The louver open/close mechanism 26 employs a lever-drive mechanism utilizing the resiliency of a coiled spring 27.

Reference is made to FIGS. 3, 7 and 8. As shown, one end of the coiled spring 27 for return is fastened to the through hole 25*a* of the engaging piece 25.

The other end of the coiled spring 27 is fixed to a fixing member 29 located in the cushion 7, through a through hole 28 formed in the rear portion of the enclosing wall 6*b* of the seat frame 6.

The coiled spring 27 (urging means) constantly urges the sound absorbing means 15 to move apart from the openings 13.

This structure provides an external force necessary for opening the slats 20.

A pair of levers 30 are formed on the parts of the rotary shaft 9, which are located corresponding to the strips 16*a* of the sound absorbing means 15 (FIGS. 3, 4, 7 and 8). Rollers 31 are rotatably provided at the tips of the levers 30 while being aligned with the strips 16*a*.

The rollers 31 are mounted so that when the seat 3 is turned from the first position X to the second position Y, it pushes the back side of the sound absorbing means 15 until the slats 20 are fully closed.

Also, the rollers 31 move apart from the strips 16*a* when the seat 3 is turned from the second position Y to the first position X.

With this mechanism, when the seat 3 is turned upward, the sound absorbers 19 are exposed through the openings 13 while slats 20 remain open, since the sound absorbing means 15 is pulled backward by the coiled spring 27. When the seat 3 is turned forward, the rollers 31 push the sound absorbing means 15, fully closing the slats 20 and the sound absorber 19 is shut off from the exterior.

Rubber sheets 32 are attached onto the surfaces of the strips 16*a* which come in contact with the rollers 31. Use of the rubber sheets 32 provide smooth turning of the rollers 31 without slippage.

An opening/adjusting mechanism 33 for adjusting the opening of the louver 20A is provided at the central part of the rear portion 8*b* of the enclosing wall that is raised from the peripheral edge of the back cover 8 (FIGS. 3 to 6, and 8).

In the structure of the opening/adjusting mechanism 33, a hole, preferably threaded, is formed at the central part of the rear portion 8*b* of the raised peripheral wall of the back cover 8. A reinforcing plate 34 with a hole, preferably threaded, is put on the inner side of the rear portion 8*b*, which faces the rear side of the case 16. A nut 35 is put on the reinforcing plate 34 in a state that the holes of those members are aligned with one another.

A bolt 36 is screwed into those holes from the outside of the case 16 until the tip of the bolt 36 comes in contact with the sound absorbing means 15.

When the seat 3 is turned upward to be vertically set at the first position X, the seat 3 is in an unoccupied state, and the opening of the louver 20A can be adjusted by turning the bolt 36.

Thus, with the movement of the tip of the bolt 36, the louver 20A gradually opens from its fully closed state, whereby the equivalent sound absorption area of the louver 20A is adjusted to a desired value.

The operation of the chair 1 thus constructed will be described.

When no sitter sits on the chair 1, or the seat 3 thereof, the seat 3 is vertically set at the first position X as shown in FIG. 1.

A sitter turns the seat 3 forward to the second position Y to set up the sitter-acceptable state (FIG. 2).

At this time, the seat 3 is turned about the rotary shaft 9 while the rotary shaft 9 is not turned.

Then, the sound absorbing means 15, which has been located apart from the rollers 31, gradually moves toward the position where it is pushed by the rollers 31, with the turn of the seat 3 (FIG. 5).

The rollers 31 come in contact with the rubber sheets 32 attached to the rear side of the sound absorbing means 15, and roll on the rubber sheets 32 to progressively push the rear side of the sound absorbing means 15.

As recalled, the sound absorbing means 15 within the seat frame 6 can be moved forward, and the slats 20 of the louver 20A may be turned about the pins 20*b* of the slats 20. Therefore, the sound absorbing means 15 is moved forward while approaching the openings 13, under the pressure of the rollers 31.

The slats 20 are gradually turned for closing, and the seat 3 is turned to the second position Y. At this time, the openings 13 are covered with the long leg parts 20*d* of the slats 20.

The openings 13 are closed by the slats 20 to be shut off from outside.

In this state, when a sitter sits on the seat 3, the sound absorbing means 15 does not operate to absorb sound.

When the sitter rises from the seat 3, the seat 3 is automatically returned to the first position X (unoccupied) with the aid of the resilience stored in the twisted, coiled spring 12.

At the same time, the sound absorbing means 15 retracts from the rollers 31. The sound absorbing means 15 is now released from the restriction by the rollers 31. Accordingly, it is pulled backward by the resilience stored in the twisted, coiled spring 27, so that the slats 20 are turned backward (to the opening position) about the pins 20*b*.

Then, the slats 20 of the louver 20A are fully opened, thereby opening the openings 13.

Since chair 1 of the present invention uses the structure to open and close the openings 13 by the slats 20, the areas of the openings 13 are considerably larger than the opening areas of the conventional chair using the punching plate.

In the conventional structure using the punched plate, the movement of the punched plate with a number of punched holes relative to the bottom side with a number of holes is used for exposing the sound absorbing member to the outside and shutting it off from the outside.

Therefore, the total area of the opening is half of the seat area, at most.

On the other hand, the chair of the present invention can secure the total area of the openings, which is considerably larger than that of the conventional one, because there is no need of such a relative movement.

Thus, when the seat 3 is raised, the sound absorbing means 15 contained in the seat 3 is exposed to the outside through the large openings 13. In this state, the chair 1 has an equivalent sound absorption area comparable to that of an occupied chair.

Specifically, the large openings 13 introduce incoming sounds into the sound absorbing means 15, to thereby greatly attenuate the sounds. Further, the sound attenuation chamber 24 attenuates incoming sounds. As a result, the total equivalent sound absorption area of the chair of the present invention is large and comparable to that of a sitter.

Thus, the chair of the present invention uses a unique seat structure with large opening areas, to thereby provide a large equivalent sound absorption area. Therefore, the chair can remarkably reduce the great difference between the equivalent sound absorption areas of the chair when the sitter sits on the chair and when the sitter does not sit on the chair. Further, the area of openings 13 is preferable for it constitutes more than 50% of an area of the seat 3 without the louver mounted.

In other words, the present invention succeeds in providing a novel and unique chair with little variation of the equivalent sound absorption area whether occupied or not.

When the chairs of the present invention are installed in a hall or a theater and the reverberation characteristics are not present, because of the size and the shape of the hall, for example, the reverberation characteristics of the hall can be adjusted as desired by adjusting the equivalent sound absorption area of the chairs. The head 26*a* of the bolt 36 in the opening/adjusting mechanism 33 is turned to move the tip of the bolt (indicated by a two-dot chain line in FIG. 5) to adjust the position of the sound absorbing means 15 when the seat is raised or unoccupied, and hence to slightly close the slats 20 from their fully opened state.

As described above, the sound absorbing performance of the chairs when the chairs are unoccupied with the listeners can be adjusted.

In an experiment conducted by the inventor, the conventional chair using the punched plate and the chair of the first embodiment of the present invention was used. The equivalent sound absorption areas of those chairs were measured when occupied and unoccupied.

Figure 10A:
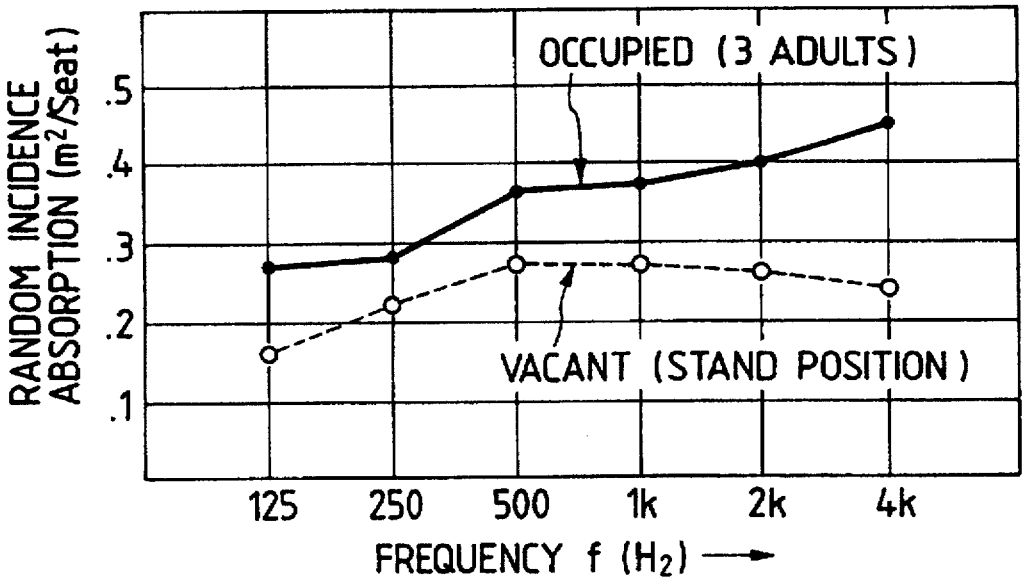
FIG. 10(*a*) is a graph showing a sound absorbing performance of a conventional chair.
Figure 10B:
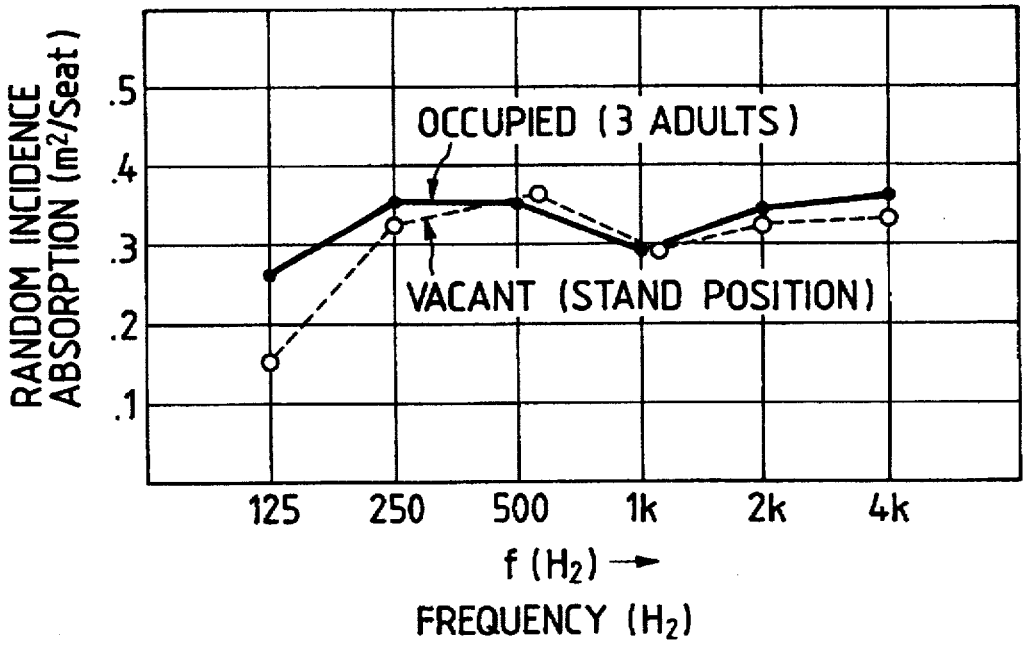

The measurement results of the conventional chair were plotted as shown in FIG. 10(*a*). The measurement results of the chair of the invention were plotted as shown in FIG. 10(*b*). As seen from the graphs, the equivalent sound absorption area of the conventional chair when it is occupied is greatly different from that when it is unoccupied (FIG. 10(*a*)). On the other hand, in the chair of the invention, the difference between the curves representative of variations of the equivalent sound absorption areas of the chairs when occupied and unoccupied is remarkably reduced (FIG. 10(*b*) ).

In the invention, the structure to open and close the openings 13 by the louver 20A is applied to the chair of the type in which the seat is turned between the first position X and the second position Y. Therefore, when the seats are unoccupied, the seats are vertically set to form a space for passage. This is an additional advantage of the chair of the invention.

Further, the louver 20A is opened and closed with the turn of the seat of the chair 3 when the sitter sits on the seat and rises from the seat. In other words, it is reliably opened and closed only by the sitter's sitting and standing actions. Reliable opening and closing operations of the seat are accomplished in a simple manner.

The structure to open and close the louver 20A consists of the combination of the coiled spring 27 that urges the sound absorbing means 15, and the levers 30 that pushes the rear side of the sound absorbing means 1. The structure is simple in construction. The coiled spring 27 and the levers 30 are located within the space 14. The space within the seat 3 is effectively used while securing the reliable opening/closing function of the louver 20A.

In the chair of the invention, the rollers 31 of the tips of the levers 30 are brought into contact with the rear side of the sound absorbing means 15. With this, the turn of the slats 20 of the louver 20A for opening and closing is smooth with little noise generated. Incidentally, in the conventional chair, the lever is brought into direct contact with the sound absorbing means.

It is noted further that the levers 30 roll on the rubber sheets 32 on the rear side of the sound absorbing means 15. Therefore, the levers 30 roll without slippage. This leads to a reliable opening/closing of the louver 20A.

Furthermore, the sound attenuation chamber 24 is provided on the rear side of the sound absorbing means 15. The chamber 24 also has the sound absorbing function. Therefore, a considerably high sound absorbing performance can be accomplished with the seat 3 alone. The structural feature brings about a remarkable reduction of the difference of the equivalent sound absorption areas of the chair when it is occupied and unoccupied.

Figure 11:
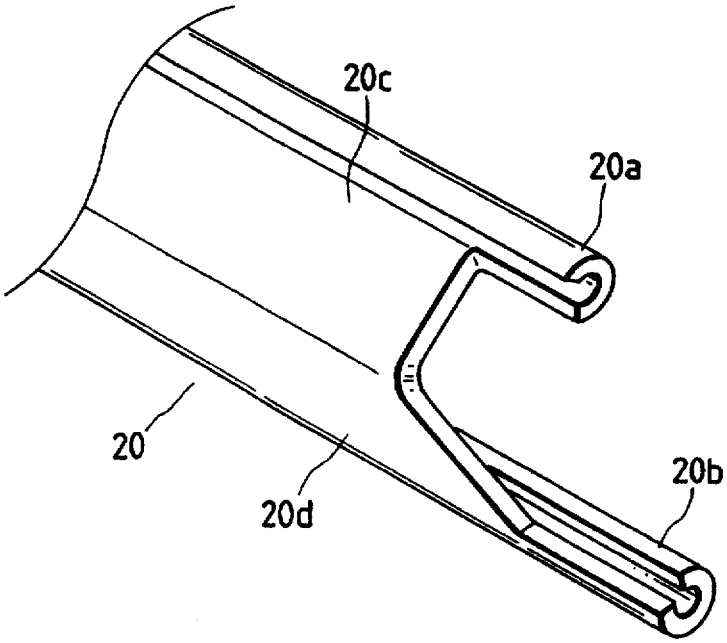
FIG. 11 is a perspective view showing another slat of the louver.
Figure 12:
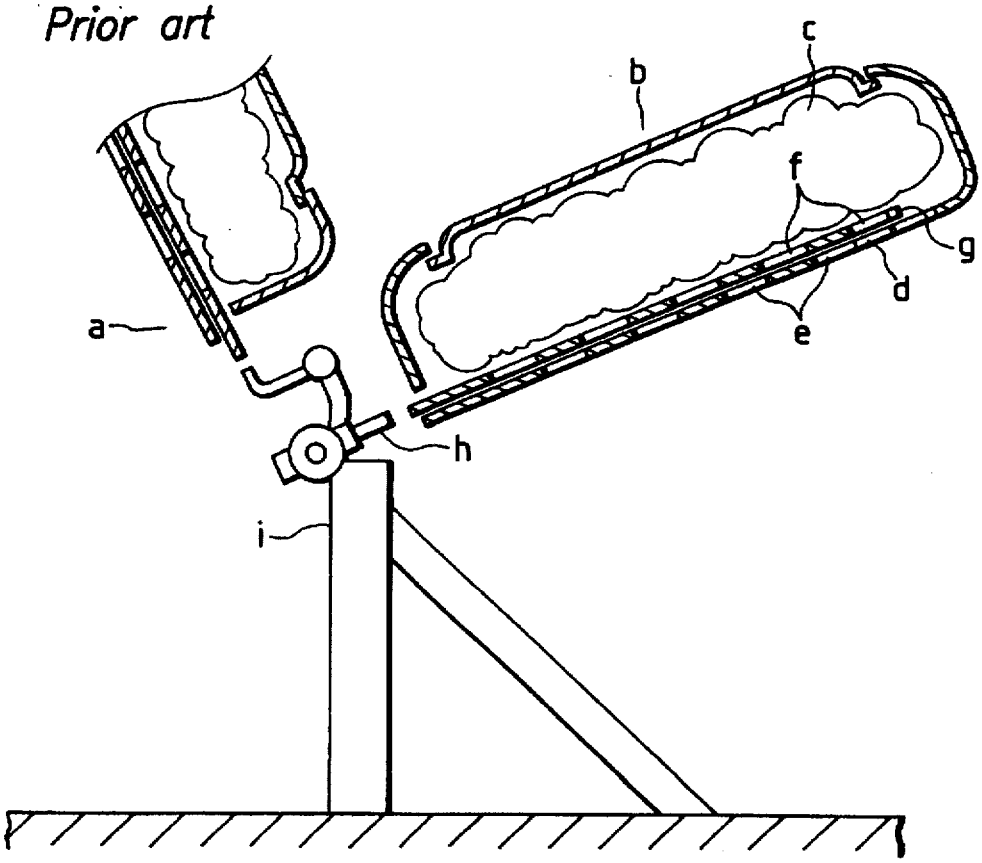
FIG. 12 Prior art
FIG. 12 is a sectional view showing the construction of a conventional chair with a sound absorbing structure contained therein.

In the first embodiment of the present invention, the slats 20 of the louver 20A are made of synthetic resin. It is evident that the slats 20 may be made of another material and take another shape. One of the slats of the louver 20A, shown in FIG. 11, is made of aluminum. The slat is also V-shaped in cross section. Rotary shafts 20*a* and 20*b*, protruding from the ends of the side edges of the slat 20, are U-shaped.

As seen from the foregoing description, the chair for acoustically designed buildings of the present invention has the following beneficial effects:

To considerably reduce the difference between the equivalent sound absorption area of the chair when occupied and unoccupied.

To secure a space for passage when the seats of the chairs are vacant since the seats are turned upward.

To achieve reliably occupied and unoccupied states of the seat by merely turning the seat.

To use effectively the space within the seat for the louvered open/close mechanism.

To open and close the louver smoothly with little noise generated.

To open and close the slats of the louver reliably by the lever.

To enable the chairs to be installed in a variety of concert halls, for example, with the use of the opening/adjusting mechanisms.

To be capable of attenuating the sound transmitted through the sound absorbing means, ensuring a large sound attenuation.

While there has been described what is at present considered to be the preferred embodiments of the invention, it will be understood that various modifications may be made therein, and it is intended to cover in the appended claims all such modifications as fall within the true spirit and scope of the invention.

What is claimed is:

1. A chair for acoustically designed buildings comprising:

a seat having an inner space;

a back located behind the seat;

primary openings formed on a bottom surface of the seat;

a sound absorbing member disposed within the inner space of the seat; and a louver comprising slats located behind the primary opening and means for adjustably controlling an exposure of the sound absorbing member to sounds in the buildings, wherein the louver is in an opened state when the seat is in a first position and the louver is in a closed state when the seat is in a second position.

2. A chair for acoustically designed buildings according to claim 1, wherein the louver includes said slats which can be adjusted by turning to form secondary openings when the louver is in the opened state and to close the secondary openings when the louver is in the closed state.

3. A chair for acoustically designed buildings according to claim 1, wherein the seat is in the first position when the seat is unoccupied and in the second position when the seat is occupied.

4. A chair for acoustically designed buildings comprising:

a seat having an inner space;

a back located behind the seat;

primary openings formed on a bottom surface of the seat;

a sound absorbing member disposed within the inner space of the seat;

a louver, including slats, located behind the primary openings for adjustably controlling an exposure of the sound absorbing member to sounds in the buildings;

a louver open/close mechanism, located behind the sound absorbing member, for opening and closing the slats, wherein the louver is in an opened state when the seat is in a first position and the louver is in a closed state when the seat is in a second position, the slats can be adjusted by turning to form secondary openings when the louver is in the opened state and to close the secondary openings when the louver is in the closed state, and the sound absorbing member is disposed behind the louver such that the louver open/close mechanism moves the sound absorbing member toward the slats to close the louver when the seat is in the second position and moves the sound absorbing member away from the slats to open the louver when the seat is in the first position.

5. A chair for acoustically designed buildings according to claim 4, wherein the louver open/close mechanism includes:

urging means, located in the inner space of the seat, for urging the sound absorbing member to move away from the slats to allow the slats to form the secondary openings when the seat is in the first position; and levers, located within the inner space of the seat, for pushing a rear side of the sound absorbing member to close the secondary openings when the seat is in the second position.

6. A chair for acoustically designed buildings according to claim 5, wherein the levers include rollers which are brought into contact with the sound absorbing member when the levers push the rear side of the sound absorbing member.

7. A chair for acoustically designed buildings according to claim 6, further comprising anti-skid layers formed on a portion of the rear side of the sound absorbing member to receive the rollers.

8. A chair for acoustically designed buildings according to claim 2, further comprising a secondary opening adjusting mechanism for adjusting a degree of a turn of the slats to adjust an area of the secondary openings.

9. A chair for acoustically designed buildings according to claim 1, further comprising:

a sound attenuation chamber located behind the sound absorbing member.

10. A chair for acoustically designed buildings according to claim 8, wherein the area of the secondary openings are more than one-half of an area of the bottom surface of the seat.

* * * * *